US006106192A

United States Patent [19]

Hargis et al.

[11] Patent Number: 6,106,192

[45] Date of Patent: Aug. 22, 2000

[54] FLOW MODIFYING DEVICE FOR PAVING SCREEDS WITH EXTENDIBLE SECTIONS

[75] Inventors: Paul L. Hargis, Humboldt; Brian Hawkins; Ted E. Holmes, both of Mattoon, all of Ill.

[73] Assignee: Blaw-Knox Construction Equipment Corp., Mattoon, Ill.

[21] Appl. No.: 09/293,813

[22] Filed: Apr. 16, 1999

Related U.S. Application Data

[60] Provisional application No. 60/082,079, Apr. 17, 1998.

[51] Int. Cl.[7] ..... E01C 19/22

[52] U.S. Cl. ..... 404/101; 404/104; 404/118

[58] Field of Search ..... 404/96, 104, 118, 404/101

[56] References Cited

U.S. PATENT DOCUMENTS

| | | | |
|---|---|---|---|
| 1,773,431 | 8/1930 | Mosel . | |
| 3,680,451 | 8/1972 | Birtchet | 404/104 |
| 3,907,451 | 9/1975 | Fisher et al. | 404/101 |
| 4,272,213 | 6/1981 | McGovarin . | |
| 4,379,653 | 4/1983 | Brown . | |
| 5,344,254 | 9/1994 | Sartain | 404/104 |

*Primary Examiner*—James A. Lisehora

*Attorney, Agent, or Firm*—Mark A. Ussai

[57] ABSTRACT

A material flow modifying device is for a screed assembly of a paving machine. The screed assembly has a main screed with a central axis extending in a direction of intended travel of the paving machine and two screed extensions movably mounted to the main screed. The flow modifying device includes a deflector member connected with the screed extension and having a flow surface facing toward the central axis of the main screed. The flow surface is contactable with paving material on a base surface and is configured to displace the material toward the central axis when the paving machine moves in the intended travel direction. The deflector member has a first end disposed adjacent to the inner vertical surface of the screed extension and a second, free end disposed proximal to the front vertical surface of the main screed, such that the second end moves laterally along the main screed during movement of the screed extension. The distance between the member second end and the central axis is greater than the distance between the member first end and the central axis, such that the flow surface is angled inwardly and rearwardly toward the main screed central axis. Preferably, the deflector member includes a main body portion attached to the screed extension and a wear plate removably attached to the main body portion. Alternatively, the deflector member is formed as a main body portion only or even as an integral portion of the screed extension.

19 Claims, 6 Drawing Sheets

FLOW MODIFYING DEVICE FOR PAVING SCREEDS WITH EXTENDIBLE SECTIONS

This application claims the benefit of U.S. Provisional Application Ser. No. 60/082,079, filed Apr. 17, 1998.

BACKGROUND OF THE INVENTION

The present invention relates to paving machines, and more particularly to screed assemblies for paving machines having a main screed portion and at least one screed extension movably connected to the main screed.

Screed assemblies 1 used with paving machines 2 to level paving material 9, typically asphalt, applied by the machine 2 onto a generally horizontal base surface 3 are well known, an example of such being depicted in FIG. 1. Further, screed assemblies 1 having both a main screed 4 and at least one extendible screed section 5 or screed extension 5 connected to the main screed 4 are also known. As a shown in FIG. 2, such a screed assembly 1 typically includes the main screed 4, often formed of two aligned sections (separate sections not shown), and at least one and generally two extendible screed sections 5 connected with the main screed 4. The screed extensions 5 are preferably movable with respect to the main screed 4, typically by means of a hydraulic cylinders (not shown) so as to either extend outwardly substantially beyond the outer ends 4*a* of the main screed 4 or retracted into centralized positions. Thus, the screed assembly 1 may be adjusted for use in paving base surfaces 3 of various widths.

Often, in material mats 7 formed using a screed assembly 1 having extendible sections 5, a pair of lines or streaks 8 appear in the mat 7 which are brighter in appearance or "shinier" than the remaining portions of the material mat 7 (FIG. 2). These streaks 8 appear in the sections of the mat 7 leveled by the regions of the screed assembly 1 where the screed assembly 1 transitions from the inner ends 5*a* of the screed extensions 5 to the outer ends 4*a* of the main screed 4. At least two factors are believed to be contribute to the appearance of the streaks 8. One factor is that fine particles of the paving material 9 tend to accumulate at the inner ends 5*a* of the extendible sections 5 during a paving operation, such that the streaks 8 are sections of the mat 7 formed with a higher concentration of fine-grained material. As finer particles are capable of being compressed more densely than larger grains, the finer particles thereby form areas that appear shinier than remaining portions of the mat 7.

Another factor that may cause or contribute to the formation of the streaks 8 is the fact that the outer sections 7*a* of the mat 7 are leveled (and thus compressed) by the screed extensions 5 prior to the inner, middle section 7*b* being leveled by the main screed 4. Thus, the outer edges of the inner mat section 7*b* are formed along a "dead zone" of already leveled and compacted material at the inner edges of the outer mat sections 7*b*. As such, there is a lack of interaction between the material particles in the adjacent regions 7*a* and 7*b* of the mat 7, which factor is also believed to lead to the formation of the streaks 8. Further, it may be that other, unknown factors contribute to, or may even be primarily responsible for, the appearance of the streaks 8 in the material mat 7.

Therefore, it is desirable to provide a screed assembly having a main screed and extendible screed sections that is capable of forming a material mat without any streaks. Further, it is desirable to provide a means for retrofitting existing screed assemblies to eliminate the above-discussed streaking

SUMMARY OF THE INVENTION

In a first aspect, the present invention is a material flow modifying device for a screed assembly of a paving machine for applying paving material upon a generally horizontal base surface. The screed assembly has a main screed with a central axis extending in a direction of intended travel of the paving machine and a screed extension mounted to the main screed. The screed extension is moveable between a first lateral position with respect to the central axis and a second lateral position with respect to the central axis. The flow modifying device comprises a deflector member connected with the screed extension and having a flow surface. The flow surface faces toward the central axis of the main screed, is contactable with paving material on the base surface, and is configured to displace the paving material toward the central axis when the paving machine moves in the intended travel direction.

In another aspect, the present invention is a device for a screed assembly of a paving machine for leveling paving material upon a generally horizontal base surface. The screed assembly has a main screed with a central axis extending in a direction of intended travel of the paving machine. A screed extension is movably connected with the main screed. The device comprises a deflector member having a first end disposed adjacent to the screed extension and a second, free end disposed proximal to the main screed. The distance between the first member end and the central axis being greater than the distance between the second member end and the central axis. A flow surface extends between the first and second member ends and is contactable with paving material on the base surface.

In an even further aspect, the present invention is also a device for a screed assembly of a paving machine for applying paving material upon a generally horizontal base surface. The screed assembly has a main screed with a central axis extending in a direction of intended travel of the paving machine and a screed extension connected with the main screed. The screed extension has an inner end facing generally toward the central axis. The device comprises deflector means for displacing paving material in a direction generally away from the end of the screed extension and toward the central axis of the main screed and attachment means for connecting the deflector means to the screed extension.

In yet another aspect, the present invention is a device for a screed assembly of a paving machine for leveling paving material upon a generally horizontal base surface. The screed assembly has a main screed with a central axis extending in a direction of intended travel of the paving machine. A screed extension is movably connected with the main screed. The device comprises a deflector member having a first end disposed adjacent to the screed extension, a second, free end disposed proximal to the main screed, the second end being offset inwardly toward the central axis with respect to the first end. A flow surface extends between the first and second ends and is contactable with paving material on the base surface.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
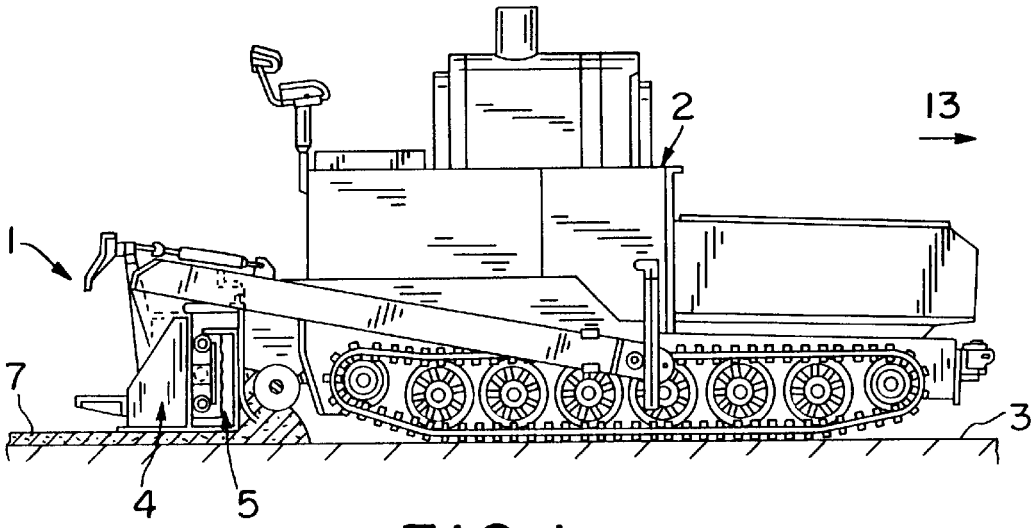
FIG. 1 PRIOR ART
FIG. 1 is a side elevational view of a paving machine with a typical screed assembly having extendible screed sections.
Figure 2:
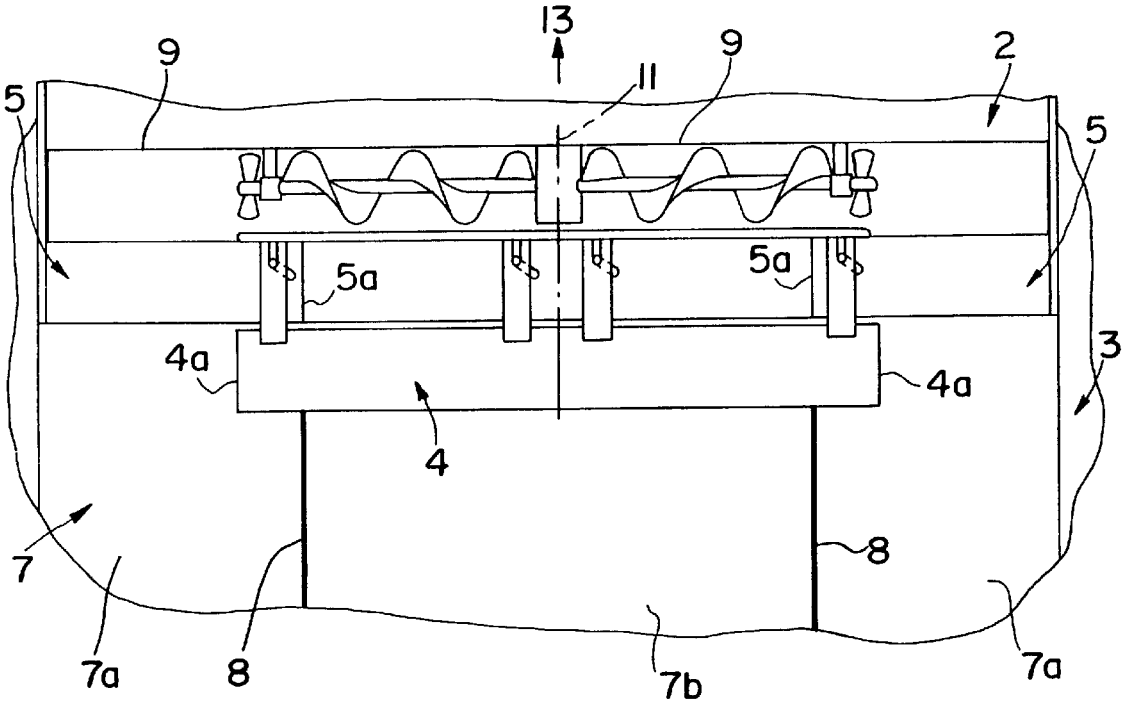
FIG. 2 PRIOR ART
FIG. 2 is a top, plan view of a typical screed assembly having extendible screed sections.

Certain terminology is used in the following description for convenience only and is not limiting. The words "right", left", "lower", "upper", "upward", "down" and "downward" designate directions in the drawings to which reference is made. The words "front", "frontward" and "rear", "rearward" refer to directions toward and away from, respectively, a designated front section of a screed assembly, a flow modifying device or a specific portion of either, the particular meaning intended being readily apparent from the context of the description. The words "inner", "inward" and "outer", "outward" refer to directions toward and away from, respectively, the designated centerline of the main screed. The terminology includes the words specifically mentioned above, derivatives thereof, and words of similar import.

Figure 3:
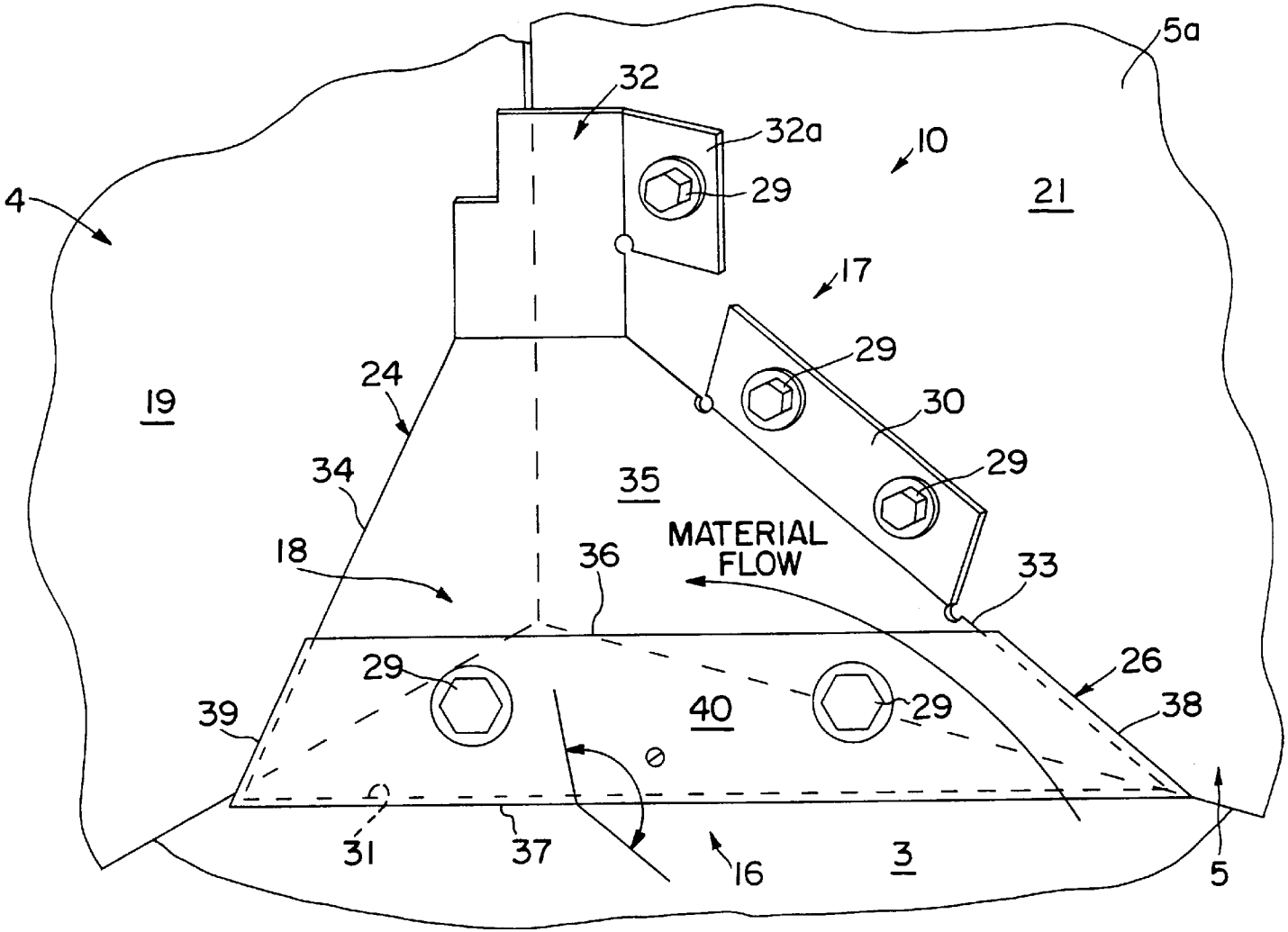
FIG. 3 is a broken-away, perspective view of the left-hand portion of a screed assembly showing a flow modifying device in accordance with a preferred construction of the present invention.
Figure 4:
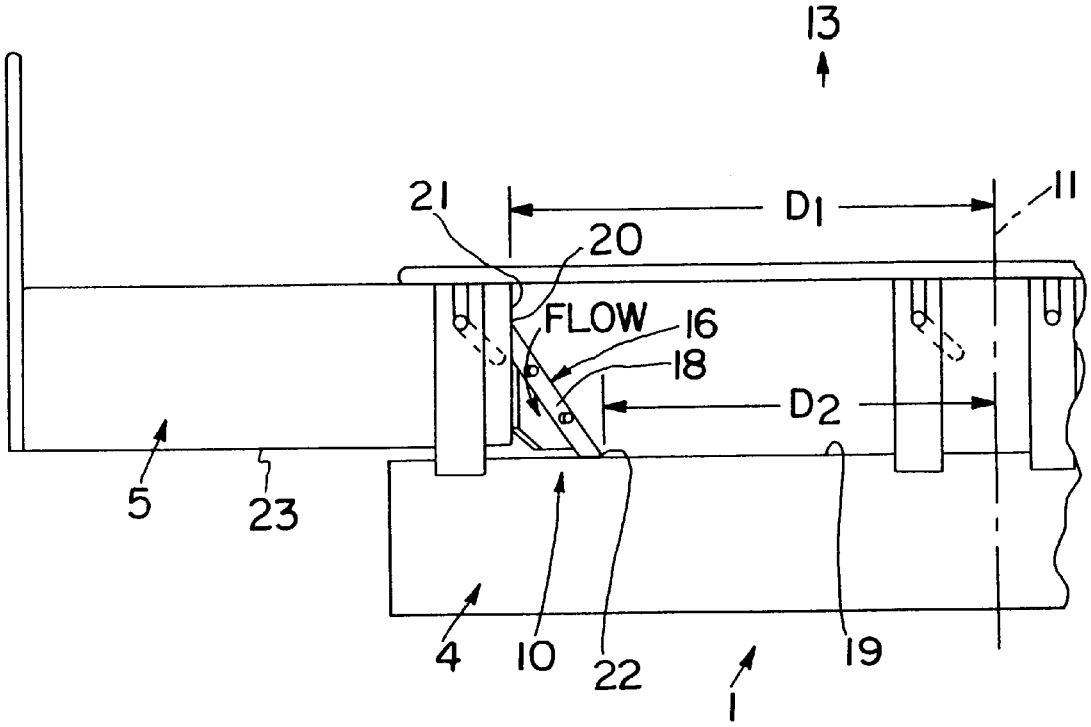
FIG. 4 is a broken-away, top plan view of the left-hand portion of a screed assembly having the flow modifying device of the present invention, showing the left-hand screed extension at an outermost position.
Figure 5:
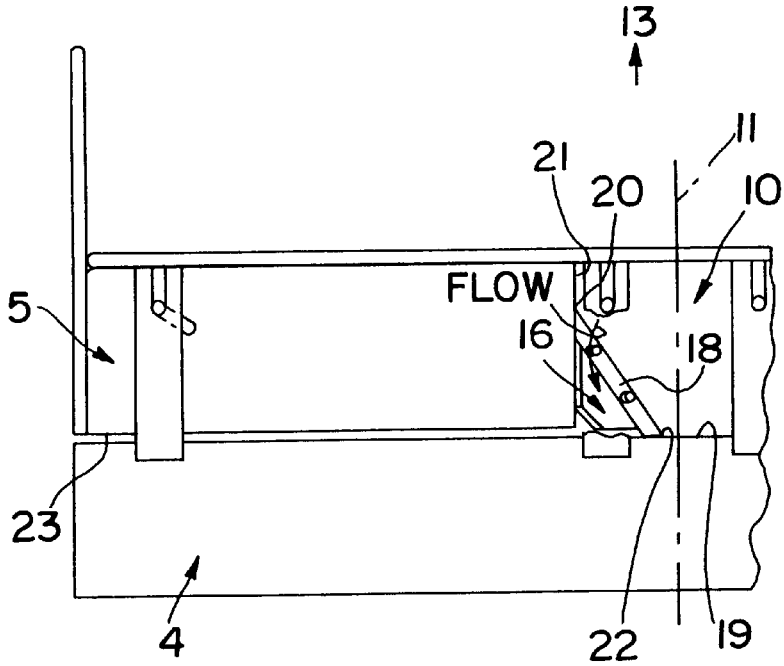
FIG. 5 is another view of the left-hand portion screed of the screed assembly of FIG. 4, showing the screed extension at an innermost position.
Figure 6:
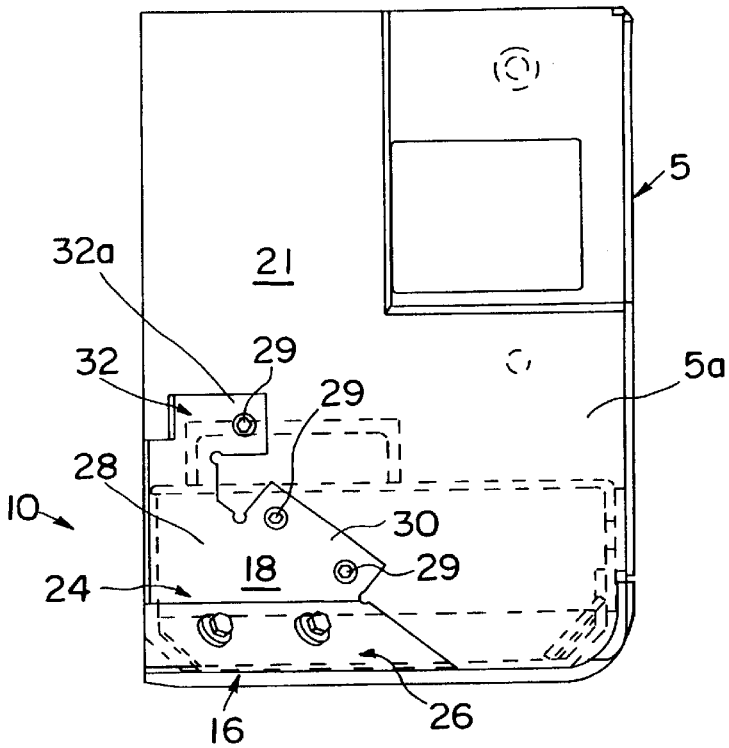
FIG. 6 is a side elevational view of the left-hand screed extension with the flow modifying device.

Referring now to the drawings in detail, wherein like numbers are used to indicate like elements throughout, there is shown in FIGS. 3–10 a material flow modifying device 10 for a screed assembly 1 of a paving machine 2 used for applying paving material upon a generally horizontal base surface 3. The screed assembly 1 has a main screed 4 with a central axis 11 extending in a direction of intended travel 13 of the paving machine 2. Further, the screed assembly 1 has at least one, and preferably two, screed extensions 5 movably connected with, and preferably mounted to, the main screed 4 so as to be moveable between a first lateral position with respect to the central axis 11 (FIG. 4) and a second lateral position with respect to the central axis 11 (FIG. 5).

More specifically, as best shown in FIGS. 3–5, the flow modifying device 10 is preferably used with a screed assembly 1 having the following basic structure. The main screed 4 has a front vertical surface 19 and the screed extension 5 has an inner end 5*a* with an inner vertical surface 21. The inner vertical surface 21 of the screed extension 5 faces generally toward the central axis 11 and is disposed generally perpendicular to the front surface 19 of the main screed 4. Preferably, as depicted in FIG. 3, the lower section 21*a* of the inner surface 21 is curved outwardly (i.e., away from the central axis 11); however, the surface 21 is primarily depicted in the drawing figures as substantially flat for ease of illustration. Further, the screed extension 5 preferably has a rear vertical surface 23 disposed adjacent to the front surface 19 of the main screed 4, such that the screed extension 5 may be described as "front-mounted". As discussed above, the screed extension 5 is an extendible screed movable between a first or "outermost" lateral position (FIG. 4) and a second or "innermost" lateral position (FIG. 5). Such a screed extension 5 is also positionable at any location between the first and second lateral positions, the depicted positions merely representing the extremes of movement of the screed extension 5 with respect to the main screed 4. Alternatively, the flow modifying device 10 may also be used with a front-mounted mounted screed extension 5 that is not movable with respect to main screed 4.

Referring again to FIGS. 3–10, the flow modifying device 10 basically comprises a deflector member 16 that is connected with one of the screed extensions 5 and attachment means 17 (see FIG. 3) for attaching the deflector member 16 to the screed extension 5, as discussed below. The deflector member 16 has a flow surface 18 contactable with paving material disposed on the base surface 3 and is configured to displace the paving material toward the central axis 11 of the main screed 4 when the paving machine 2 moves in the intended travel direction. More specifically, the flow surface 18 is angled with respect to and faces toward the main screed central axis 11 such that paving material contacting the flow surface 18 is directed laterally inwardly toward the central axis 11. Preferably, the screed assembly 1 has two flow modifying devices 10, a left-hand device 10 and a right-hand device 10, each being connected with the respective right and left hand screed extensions 5. As the left-hand and right-hand devices 10 are generally identical to the each other, but oppositely oriented with respect to the central axis 11, only a left-hand flow modifying device 10 (for use with the left-hand screed extension 5) is described in detail herein so as to clarify the description of the present invention.

Referring now to FIGS. 3–7, 9 and 10, in further detail, the deflector member 16 preferably has a first end 20 disposed adjacent to the screed extension 5 and a second, free end 22 disposed proximal to the main screed 4. More specifically, the deflector member 16 extends between the inner vertical surface 21 of the screed extension 5 and the front vertical surface 19 of the main screed 4. Referring specifically to FIG. 4, the deflector member 16 is angled inwardly toward the central axis 11 such that the distance $D_1$ between the first end 20 and the central axis 11 is greater than the distance $D_2$ between the second end 22 and the central axis 11. In other words, the second end 22 is offset inwardly toward the central axis 11 with respect to the first end 20. Furthermore, the second end 22 of the deflector member 16 moves laterally along or with respect to, and preferably in sliding contact with, the main screed 4 when the screed extension 5 moves between the first and second positions (FIGS. 4 and 5).

Preferably, the flow surface 18 is disposed so as to extend vertically and rearwardly at an obtuse angle θ with respect to the base surface 3, as indicated in FIG. 3. Thus, the flow surface 18 is arranged so as to function similarly to the surface of a plow blade to direct or displace paving material inwardly toward the central axis 11 and, simultaneously, rearwardly toward the main screed 4. Alternatively, although not preferred, the deflector member 16 may be constructed such that the flow surface 18 extends vertically so as to be substantially perpendicular to the base surface 3 (not depicted), as such a configuration of the member 16 is capable of functioning to displace paving material inwardly toward the central axis 11. Further, the deflector member 16 may be adjustably positionable with respect to the screed extension 5 to vary a vertical position of the flow surface 18 with respect to the base surface 3, as discussed below.

Figure 7:
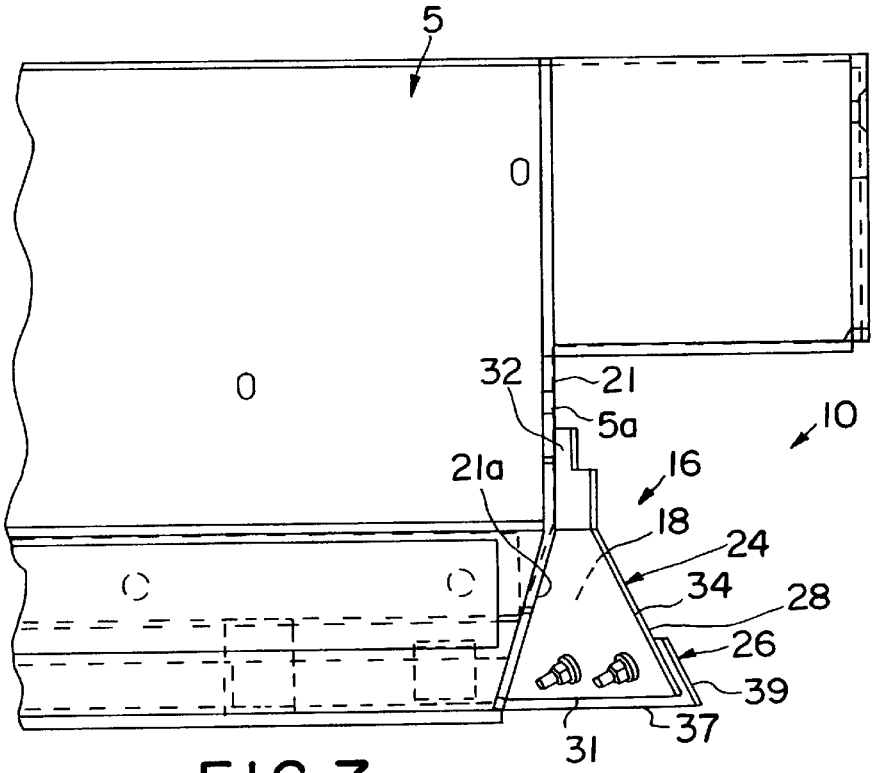
FIG. 7 is a broken-away, rear elevational view of the left-hand screed extension with the flow modifying device.
Figure 8:
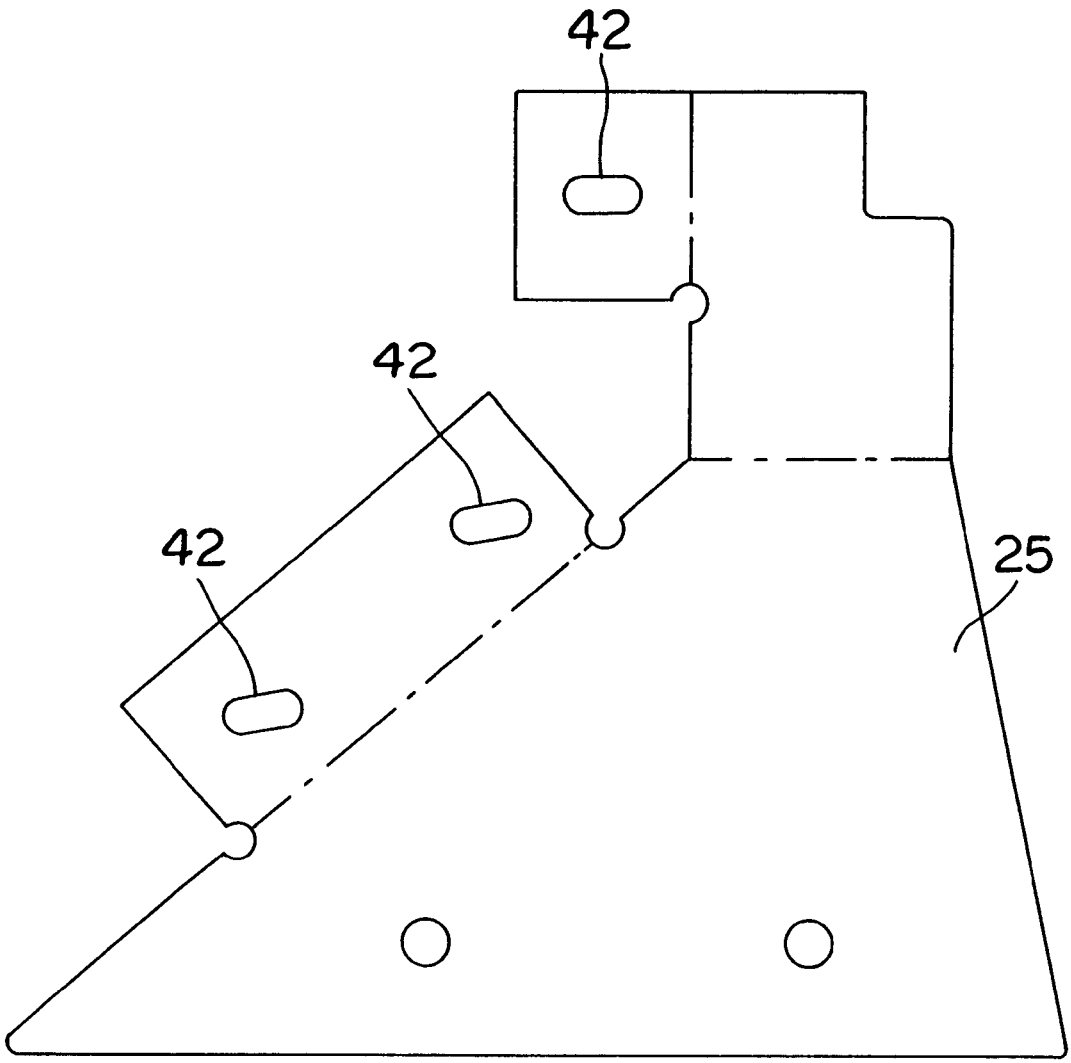
FIG. 8 is a top plan view of a blank used to form the preferred deflector member.

Referring now to FIGS. 3–8, a preferred construction of the flow modifying device 10 has a deflector member 16 that includes a first or main body portion 24 attached to the screed extension 5 and a second portion or wear plate 26 removably attached to the first, main body portion 24. The main body portion 24 is preferably formed as a complexly-shaped plate with bended portions and includes a primary section 28, a mounting tab section 30 and an upper brace section 32. A flat blank 25 capable of forming the main body portion 24 as described herein is depicted in FIG. 8. The primary section 28 preferably has a truncated-triangular shape and includes a lower generally horizontal edge 31 and first and second converging vertical side edges 33 and 34. Most preferably, the first or front vertical side edge 33 extends along the lower vertical surface section 21*a* of the screed extension 5, as depicted in FIG. 7. Further, the primary section 28 has a generally flat, front surface 35 (FIG. 3) that provides a portion of the flow surface 18, as discussed below.

Further, the mounting tab section 30 extends upwardly with respect to the primary section 28 from the first side edge 33. The tab section 30 is attached to the inner vertical surface 21 of the screed extension 5, preferably by means of two threaded fasteners 29, to thereby form attachment means 17 to connect the deflector member 16 to the screed extension 5. The brace section 32 extends from the upper end of the primary section 28 and includes an angled, secondary mounting tab section 32*a* disposed against and attached to the inner vertical surface 21 of the screed extension 5, also preferably by means of a threaded fastener 29. Most preferably, the brace section 32 is located with respect to the screed extension 5 so as to extend upwardly from the intersection of the lower vertical surface section 21*a* with the remainder of the vertical surface 21, as shown in FIG. 7. The brace section 32 provides rigidity and support to the primary section 28, such that any loading on the main body portion 24 (i.e., due to the weight of paving material) does not cause the primary section 28 to deflect or bend downwardly with respect to the mounting tab section 30 (and thus with respect to the screed extension 5). Further, each of the tab sections 30, 32*a* preferably includes slotted openings 42 (see FIG. 8) through which extend the fasteners 29 so as to enable adjustment of the horizontal position of the deflector member 16 with respect to the screed extension 5, main screed 4 and/or base surface 3.

However, the main body portion 24 may alternatively be formed without the brace section 32 as the deflector member 16 is capable of functioning as described below without any such brace section. As a further alternative, the inner surface 21 of the screed extension 5 may include slotted openings (not shown) to enable horizontal (and possibly vertical) adjustment of the deflector member 16, instead of providing the openings 42 through the tab sections 30, 32*a*. Furthermore, the mounting tab sections 30, 32*a* may be attached to the inner surface 21 of the screed extension 5 by any other appropriate means, such as by riveting or by welding, particularly if adjustment of the deflector member 16 is not required or desired.

As best shown in FIG. 3, the wear plate 26 is preferably formed as a generally flat plate having a front surface 40, upper and lower, generally parallel horizontal edges 36 and 37, respectively, and first and second converging, vertically-extending side edges 38 and 39, respectively. The wear plate 26 is disposed against and removably attached to the front surface 35 of the main body portion 24, preferably by means of two threaded fasteners 29. Preferably, the "width" of the flow plate 26 (i.e., the orthogonal distance between the upper and lower horizontal edges 36, 37, respectively) is selected such that the lower horizontal edge 37 is disposed at a desired vertical position with respect to the base surface 3. Alternatively, either the wear plate 26 or the main body portion 24 may include vertically-extending slotted openings (not shown) through which extend the threaded fasteners 29 that attach the plate 26 to the body portion 24. Thus, the wear plate 26 may be adjustably positionable on the main body portion 24 so as to vary the vertical position of the deflector member 16 with respect to the base surface 3.

With the wear plate 26 attached to the main body portion 24 as depicted and discussed above, the flow surface 18 is provided by the combination of the front surface 40 of the wear plate 26 and the section of the front surface 35 of the main body portion 24 located above the wear plate 26. Preferably, the flow surface 18 is a generally flat surface, although alternatively, the deflector member 16 may be formed such that the flow surface 18 is either concavely or convexly curved (i.e., inwardly or outwardly with respect to the front of the deflector member 18) if desired.

Further, when the wear plate 26 is attached to the main body portion 24, the first or front side edge 38 of the wear plate 26 is generally parallel to and aligned with the first, front edge 33 of the main body portion 24, such that the front edges 33, 38 abut against and extend upwardly and rearwardly along the inner vertical surface 21 of the screed extension 5, most preferably along the lower vertical surface section 21*a* (see FIG. 7). As the two edges 33, 38 abut against the inner surface 21 of the screed extension 5, paving material contacting the deflector member 16 is unable to flow between the deflector member 16 and the inner surface 21 of the screed extension 5 and is instead directed inwardly and rearwardly along the flow surface 18, as discussed in further detail below. Further, the front edges 33 and 38 of the main body portion 24 and the wear plate 26, respectively, form the first or front end 20 of the deflector member 16, as discussed above.

As best shown in FIGS. 3 and 7, the lower edge 37 of the wear plate 26 extends generally parallel with, but spaced below, the lower horizontal edge 31 of the main body portion 24. Further, the second or rear edge 39 of the wear plate 26 is generally parallel with, but spaced rearwardly of, the rear side edge 34 of the main body portion 24. Thus, the rear side edge 39 of the wear plate 26 forms the second or rear end 22 of the deflector member 16, as discussed above. Preferably, the rear side edge 39 of the wear plate 26 is disposed against (i.e., in contact with) the front surface 19 of the main screed 4 such that the rear edge 39 slides laterally against the main screed 4 during movement of the screed extension 5. Alternatively, the rear edge 39 of the wear plate 26 may be spaced from the front surface 19 of the main screed 4.

By having the lower and rear side edges 37 and 39, respectively, of the wear plate 26 being spaced from the lower and rear side edges 31 and 34, respectively, of the main body portion 24, the only portions of the deflector member 16 that slides against either other portions of the screed assembly 1 or against paving material are the two edges 37, 39 of the wear plate 26. In other words, the lower edge 37 is slidingly contactable with paving material on the base surface 3 and the rear edge 39 is slidingly contactable with the front surface of the main screed 4. Sliding contact causes material abrasion to occur that will eventually necessitate replacement of any components repeatedly experiencing such contact. Thus, the wear plate 26 may be replaced without necessitating more expensive repair or replacement of the entire flow modifying device 10.

Figure 9:
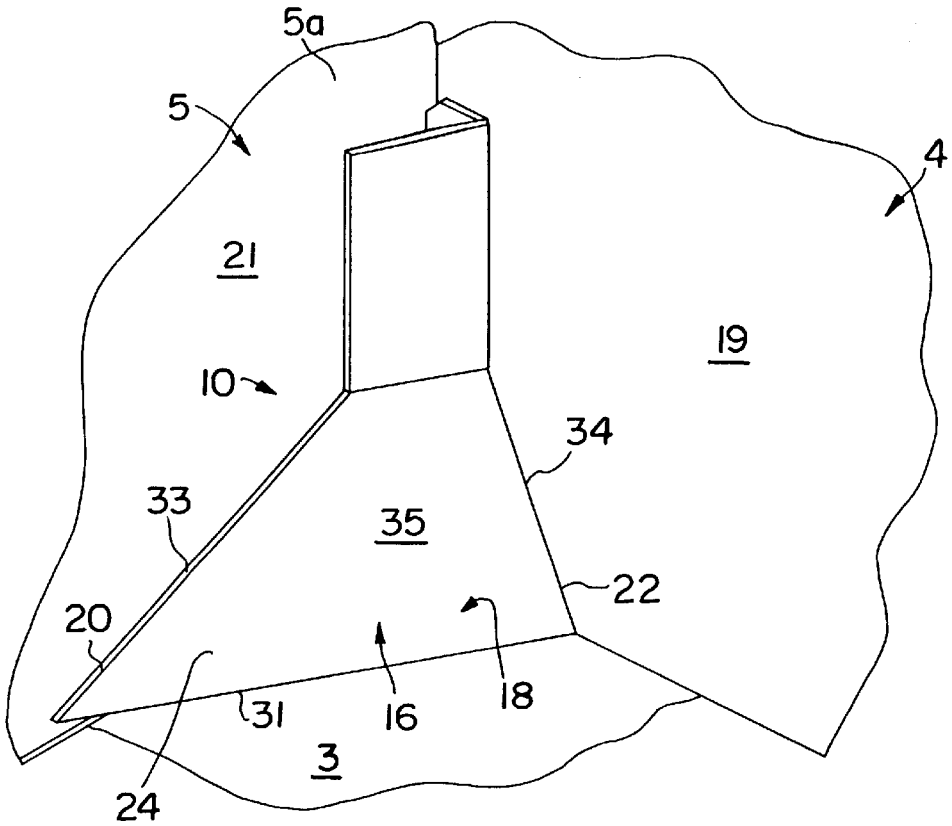
FIG. 9 is a broken-away, perspective view of the right-hand portion of a screed assembly showing a first alternative construction of a flow modifying device in accordance with the present invention.

In a first alternative construction shown in FIG. 9 (depicting a right-hand device 10), the deflector member 16 does not include a wear plate, but consists of solely of a main body portion 24 attached to the screed extension 5. The first alternative construction is otherwise identical to the preferred construction described above, except for the following specific differences. The front surface 35 of the body portion 24 completely provides the flow surface 18. Further, the first side edge 33 of the body portion 24 provides the first end 20 of the deflector member 16 and the rear side edge 34, which preferably contacts and is slidable along the front surface 19 of the main screed 4, provides the second end 22 of the deflector member 18.

Figure 10:
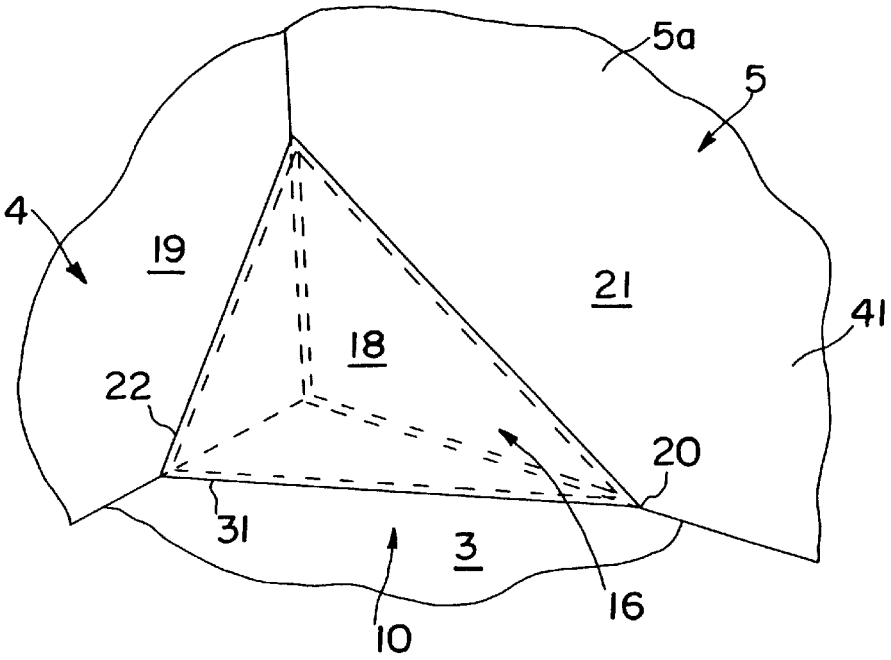
FIG. 10 is a broken-away, perspective view of the left-hand portion of a screed assembly showing a second alternative construction of a flow modifying device in accordance with the present invention.

Referring to FIG. 10, in a second alternative construction, each screed extension 5 may formed with an integral deflector member 16 extending from the inner surface 21 of the screed extension 5 and toward the central axis 11 and formed such that the distance between the first end 20 and the central axis 11 is greater than the distance between the second end 22 and the central axis 11. In other words, the second end 22 is offset inwardly toward the central axis 11 with respect to the first end 20. Such an integral deflector member 16 may be formed, for example, by bending a "flap" portion of the vertical wall 41 providing the inner surface 21 of the screed extension 5 toward the central axis 11. As an even further alternative (not shown), the deflector member 16 may be formed as a generally solid member (i.e., having a substantial thickness) of an appropriate shape as opposed to being a plate and having a surface providing the flow surface 18. The present invention embraces these alternative constructions and any other alternative construction of the deflector member 16 than enables the flow modifying device 10 to function as described herein.

In use, the paving machine 2 moves in the intended travel direction 13 such that the screed assembly 1 contacts a head of paving material deposited by the feed system (not shown) of the paving machine 2. As the screed assembly 1 approaches the head of deposited material, the right and left screed extensions 5 make first contact with the paving material and begin leveling or compacting the outermost sections of the paving material. A short time interval thereafter, the right and left flow modifying devices 10 contact and "plow" into the paving material at the outer edges of the central section of deposited paving material such that the material impacts with the flow surfaces 18.

The configuration of the deflector member 16 (as described above) causes the paving material to be displaced or to "flow" across the paving surface 18 both inwardly toward the central axis 11 and, simultaneously, rearwardly toward the main screed 4. More specifically, as the deflector surface 18 is disposed at the obtuse angle with respect to the base surface 3, the lower edge 37 of the wear plate 26 (or the edge 31 of the deflector member 16 in the alternative constructions) "wedges" under the mass of paving material such that the material also tends to flow upwardly on the flow surface 18 as it flows inwardly and rearwardly, as diagrammatically indicated by arrow 40 in FIG. 3. Thereafter, paving material in the central portion (i.e., in front of the main screed 4) is then leveled/compacted by the main screed 4. After the initial contact with a head of material deposited by the paving machine 2, the leveling of material by the screed extensions 5 and the main screed 4, and the flow or displacement of material inwardly toward the central axis 11 by the flow modifying devices 10, all occur simultaneously as the paving machine 2 moves in the intended travel direction 13.

Thus, when paving with a screed assembly 1 having the flow modifying devices 10, there is no interface between outwardly disposed paving material that is being leveled by one of the screed extensions 5 and adjacent, inwardly disposed material that remains substantially "unworked" by the screed assembly 1 until being contacted by the main screed 4. As such, the flow of paving material laterally across the length of the screed assembly 1 is generally more dynamic then with screed assemblies that do not have a flow modifying devices 10. Further, finer particles of asphalt, which as discussed above tend to accumulate at the inner ends 5*a* of the screed extensions 5, are directed inwardly by the deflector member 16 and mix with larger grains of paving material in the central section of the material deposit. Regardless of what material mechanism is actually responsible for the formation of the streaks 8 in a finished mat 7 (as discussed in the Background section), the use of the flow modifying devices 10 with a screed assembly 1 should significantly reduce the occurrence of streaks 8 in a mat 7 leveled therewith.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A screed assembly for a paving machine for applying paving material upon a generally horizontal base surface, the screed assembly comprising:

a main screed with a central axis extending in a direction of intended travel of the paving machine;

a screed extension mounted to the main screed so as to be moveable between a first lateral position with respect to the central axis and a second lateral position with respect to the central axis; and a flow modifying device including a deflector member connected with the screed extension and having a flow surface facing toward the central axis of the main screed, contactable with paving material on the base surface and configured to displace the paving material toward the central axis when the paving machine moves in the intended travel direction.

2. The screed assembly as recited in claim 1 wherein the deflector member has a first end disposed adjacent to the screed extension and a second, free end disposed proximal to the main screed, the second end moving laterally with respect to the main screed when the screed extension moves between the first and second positions.

3. The screed assembly as recited in claim 1 wherein the deflector member has a first end disposed adjacent to the screed extension and a second end disposed proximal to the main screed, a distance between the second end and the central axis being greater than a distance between the first end and the central axis.

4. The screed assembly as recited in claim 1 wherein the deflector member has a first end disposed adjacent to the screed extension, a second, free end disposed proximal to the main screed, the second end being offset inwardly toward the central axis with respect to the first end.

5. The screed assembly as recited in claim 1 wherein:

the main screed has a front vertical surface;

the screed extension has an inner vertical surface facing generally toward the central axis and disposed generally perpendicular to the front surface of the main screed, and a rear vertical surface disposed adjacent to the front surface of the main screed; and the deflector member extends between the inner vertical surface of the screed extension and the front vertical surface of the main screed.

6. The screed assembly as recited in claim 1 wherein the flow surface extends vertically and rearwardly at an obtuse angle with respect to the base surface.

7. The screed assembly as recited in claim 1 wherein the deflector member includes a first portion attached to the screed extension and a second portion removably attached to the first portion.

8. The screed assembly as recited in claim 1 wherein the deflector member is adjustably attached to the screed extension so as to enable adjustment of a horizontal position of the deflector member with respect to at least one of the screed extension, the main screed and the base surface.

9. A screed assembly for a paving machine for leveling paving material upon a generally horizontal base surface, the screed assembly comprising:

a main screed with a central axis extending in a direction of intended travel of the paving machine;

a screed extension movably connected with the main screed; and a deflector member having a first end disposed adjacent to the screed extension, a second, free end disposed proximal to the main screed, a distance between the first end and the central axis being greater than a distance between the second end and the central axis, and a flow surface extending between the first and second ends and contactable with paving material on the base surface.

10. The screed assembly as recited in claim 9 wherein the flow surface displaces the paving material toward the central axis of the main screed when the paving machine moves in the intended travel direction.

11. The screed assembly as recited in claim 9 wherein:

the screed extension is mounted to the main screed so as to be moveable between a first, most distal lateral position with respect to the central axis and a second, most proximal lateral position with respect to the central axis; and the second end of the deflector member moves laterally along the main screed when the screed extension moves between the first and second positions.

12. The screed assembly as recited in claim 9 wherein:

the main screed has a front vertical surface;

the screed extension has an inner vertical surface facing generally toward the central axis and disposed generally perpendicular to the front surface of the main screed, and a rear vertical surface disposed adjacent to the front surface of the main screed; and the deflector member extends between the inner vertical surface of the screed extension and the front surface of the main screed.

13. The screed assembly as recited in claim 9 wherein the deflector member is adjustably attached to the screed extension so as to enable adjustment of a horizontal position of the deflector member with respect to at least one of the screed extension, the main screed and the base surface.

14. The screed assembly as recited in claim 9 wherein the deflector member includes a first portion attached to the screed extension and a second portion removably attached to the first portion, the second portion having an edge slidingly contactable with the main screed and another edge slidingly contactable with the paving material.

15. A screed assembly for a paving machine for applying paving material upon a generally horizontal base surface, the screed assembly comprising:

a main screed with a central axis extending in a direction of intended travel of the paving machine;

a screed extension connected with the main screed and having an inner end facing generally toward the central axis;

deflector means for displacing paving material in a direction from the end of the screed extension and toward the central axis of the main screed; and attachment means for connecting the deflector means to the screed extension.

16. The screed assembly as recited in claim 15 wherein the screed extension is movably connected with the main screed such that the deflector means is movable with respect to the main screed.

17. A screed assembly for a paving machine for leveling paving material upon a generally horizontal base surface, the screed assembly comprising:

a main screed with a central axis extending in a direction of intended travel of the paving machine;

a screed extension movably connected with the main screed; and a deflector member having a first end disposed adjacent to the screed extension, a second, free end disposed proximal to the main screed, the second end being offset inwardly toward the central axis with respect to the first end, and a flow surface extending between the first and second ends and contactable with paving material on the base surface.

18. The screed assembly as recited in claim 17 wherein the flow surface displaces the paving material toward the central axis of the main screed when the paving machine moves in the intended travel direction.

19. The screed assembly as recited in claim 17 wherein the deflector member includes a first portion attached to the screed extension and a second portion removably attached to the first portion, the second portion having an edge slidingly contactable with the main screed and another edge slidingly contactable with the paving material.

* * * * *

US006106192C1

(12) EX PARTE REEXAMINATION CERTIFICATE (10158th)

United States Patent
Hargis et al.

(10) Number: US 6,106,192 C1
(45) Certificate Issued: May 13, 2014

(54) FLOW MODIFYING DEVICE FOR PAVING SCREEDS WITH EXTENDIBLE SECTIONS

(75) Inventors: Paul L. Hargis, Humboldt, IL (US); Brian Hawkins, Mattoon, IL (US); Ted E. Holmes, Mattoon, IL (US)

(73) Assignee: Blaw-Knox Construction Equipment Corporation, Mattoon, IL (US)

Reexamination Request:
No. 90/012,812, Mar. 20, 2013

Reexamination Certificate for:

| | |
|---|---|
| Patent No.: | **6,106,192** |
| Issued: | **Aug. 22, 2000** |
| Appl. No.: | **09/293,813** |
| Filed: | **Apr. 16, 1999** |

Related U.S. Application Data

(60) Provisional application No. 60/082,079, filed on Apr. 17, 1998.

(51) Int. Cl.
*E01C 19/22* (2006.01)

(52) U.S. Cl.
USPC ..... 404/101; 404/104; 404/118

(58) Field of Classification Search
None
See application file for complete search history.

(56) References Cited

To view the complete listing of prior art documents cited during the proceeding for Reexamination Control Number 90/012,812, please refer to the USPTO's public Patent Application Information Retrieval (PAIR) system under the Display References tab.

*Primary Examiner* — Danton Demille

(57) ABSTRACT

A material flow modifying device is for a screed assembly of a paving machine. The screed assembly has a main screed with a central axis extending in a direction of intended travel of the paving machine and two screed extensions movably mounted to the main screed. The flow modifying device includes a deflector member connected with the screed extension and having a flow surface facing toward the central axis of the main screed. The flow surface is contactable with paving material on a base surface and is configured to displace the material toward the central axis when the paving machine moves in the intended travel direction. The deflector member has a first end disposed adjacent to the inner vertical surface of the screed extension and a second, free end disposed proximal to the front vertical surface of the main screed, such that the second end moves laterally along the main screed during movement of the screed extension. The distance between the member second end and the central axis is greater than the distance between the member first end and the central axis, such that the flow surface is angled inwardly and rearwardly toward the main screed central axis. Preferably, the deflector member includes a main body portion attached to the screed extension and a wear plate removably attached to the main body portion. Alternatively, the deflector member is formed as a main body portion only or even as an integral portion of the screed extension.

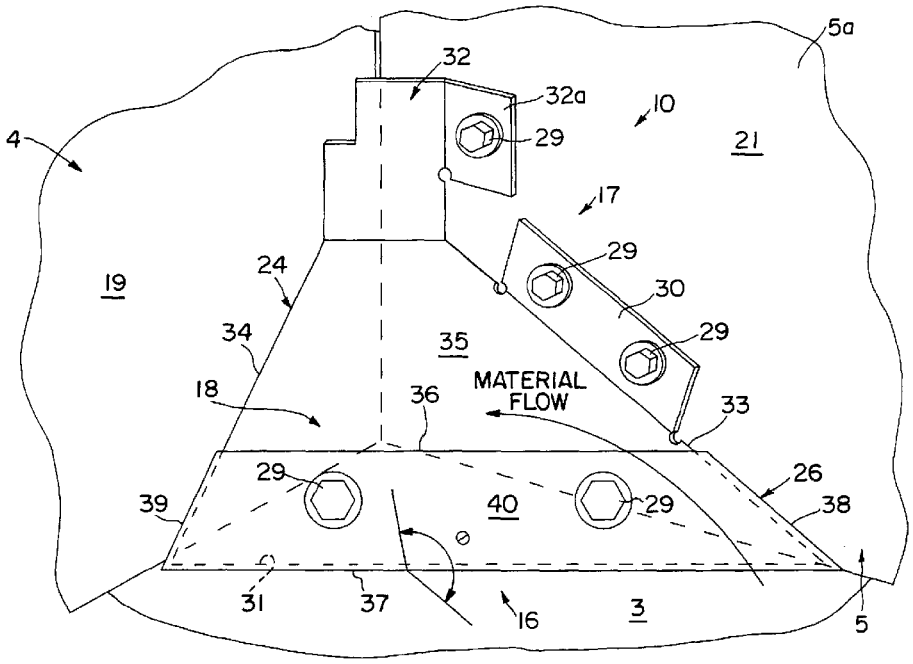

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 5, 9, 12 and 17 are determined to be patentable as amended.

Claims 2, 4, 6-8, 10, 11, 13, 14, 18 and 19, dependent on an amended claim, are determined to be patentable.

New claims 20-22 are added and determined to be patentable.

Claims 15 and 16 were not reexamined.

1. A screed assembly for a paving machine for applying paving material upon a generally horizontal base surface, the screed assembly comprising:

a main screed with a central axis extending in a direction of intended travel of the paving machine;

a screed extension mounted to the main screed so as to be moveable between a first lateral position with respect to the central axis and a second lateral position with respect to the central axis, *wherein the screed extension has an inner vertical surface that faces generally toward the central axis*; and a flow modifying device including a deflector member connected with the screed extension and having a flow surface facing toward the central axis of the main screed, contactable with paving material on the base surface and configured to displace the paving material toward the central axis when the paving machine moves in the intended travel direction, *and wherein the flow surface slopes downwardly from the inner vertical surface toward the central axis*.

3. The screed assembly as recited in claim 1 wherein the deflector member has a first end disposed adjacent to the screed extension and a second end disposed proximal to the main screed, a distance between the second end and the central axis being less [greater] *less* than a distance between the first end and the central axis.

5. The screed assembly as recited in claim 1 wherein:

the main screed has a front vertical surface;

the screed extension has [an inner vertical surface facing generally toward the central axis and disposed generally perpendicular to the front surface of the main screed, and] a rear vertical surface disposed adjacent to the front surface of the main screed; and the deflector member extends between the inner vertical surface of the screed extension and the front vertical surface of the main screed.

9. A screed assembly for a paving machine for leveling paving material upon a generally horizontal base surface, the screed assembly comprising:

a main screed with a central axis extending in a direction of intended travel of the paving machine;

a screed extension movably connected with the main screed, *wherein the screed extension has an inner vertical surface that faces generally toward the central axis*; and a deflector member having a first end disposed adjacent to the screed extension, a second, free end disposed proximal to the main screed, a distance between the first end and the central axis being greater than a distance between the second end and the central axis, and a flow surface extending between the first and second ends and contactable with paving material on the base surface, *and wherein the flow surface slopes downwardly from the inner vertical surface toward the central axis*.

12. The screed assembly as recited in claim 9 wherein:

the main screed has a front vertical surface;

the screed extension has [an inner vertical surface facing generally toward the central axis and disposed generally perpendicular to the front surface of the main screed, and] a rear vertical surface disposed adjacent to the front surface of the main screed; and the deflector member extends between the inner vertical surface of the screed extension and the front surface of the main screed.

17. A screed assembly for a paving machine for leveling paving material upon a generally horizontal base surface, the screed assembly comprising:

a main screed with a central axis extending in a direction of intended travel of the paving machine;

a screed extension movably connected with the main screed, *wherein the screed extension has an inner vertical surface that faces generally toward the central axis*; and a deflector member having a first end disposed adjacent to the screed extension, a second, free end disposed proximal to the main screed, the second end being offset inwardly toward the central axis with respect to the first end, and a flow surface extending between the first and second ends and contactable with paving material on the base surface, *and wherein the flow surface slopes downward from the inner vertical surface toward the central axis*.

*20. A screed assembly for a paving machine for applying paving material upon a generally horizontal base surface, the screed assembly comprising:*

*a main screed with a central axis extending in a direction of intended travel of the paving machine;*

*a screed extension mounted to the main screed so as to be moveable between a first lateral position with respect to the central axis and a second lateral position with respect to the central axis; and*

*a flow modifying device including a deflector member connected with the screed extension and having a flow surface facing toward the central axis of the main screed, contactable with paving material on the base surface and configured to displace the paving material toward the central axis when the paving machine moves in the intended travel direction;*

*wherein the main screed includes a front upwardly extending surface that extends both laterally across the central axis and upward from the generally horizontal base surface such that it extends above the flow modifying device.*

*21. A screed assembly for a paving machine for leveling paving material upon a generally horizontal base surface, the screed assembly comprising:*

*a main screed with a central axis extending in a direction of intended travel of the paving machine;*

*a screed extension movably connected with the main screed; and*

*a deflector member having a first end disposed adjacent to the screed extension, a second, free end disposed proximal to the main screed, a distance between the first end and the central axis being greater than a distance between the second end and the central axis, and a flow surface extending between the first and second ends and contactable with paving material on the base surface;*

*wherein the main screed includes a front upwardly extending surface that extends both laterally across the central axis and upward from the generally horizontal base surface such that it extends above the flow modifying device.*

*22. A screed assembly for a paving machine for leveling paving material upon a generally horizontal base surface, the screed assembly comprising:*

*a main screed with a central axis extending in a direction of intended travel of the paving machine;*

*a screed extension movably connected with the main screed; and*

*a deflector member having a first end disposed adjacent to the screed extension, a second, free end disposed proximal to the main screed, the second end being offset inwardly toward the central axis with respect to the first end, and a flow surface extending between the first and second ends and contactable with paving material on the base surface;*

*wherein the main screed includes a front upwardly extending surface that extends both laterally across the central axis and upward from the generally horizontal base surface such that it extends above the flow modifying device.*

* * * * *